US009333739B2

(12) United States Patent
Scharkus et al.

(10) Patent No.: US 9,333,739 B2
(45) Date of Patent: May 10, 2016

(54) PRINTING PRESS WITH MOBILE INKING CARRIAGE

(71) Applicant: KBA-NOTASYS SA, Lausanne (CH)

(72) Inventors: Volker Scharkus, Würzburg (DE); Volkmar Rolf Schwitzky, Würzburg (DE)

(73) Assignee: KBA-NotaSys SA, Lausanne (CH)

( * ) Notice: Subject to any disclaimer, the term of this patent is extended or adjusted under 35 U.S.C. 154(b) by 0 days.

(21) Appl. No.: 14/391,348

(22) PCT Filed: Apr. 10, 2013

(86) PCT No.: PCT/IB2013/052846

§ 371 (c)(1),
(2) Date: Oct. 8, 2014

(87) PCT Pub. No.: WO2013/153519

PCT Pub. Date: Oct. 17, 2013

(65) Prior Publication Data

US 2015/0107469 A1 Apr. 23, 2015

(30) Foreign Application Priority Data

Apr. 10, 2012 (EP) ..... 12163548

(51) Int. Cl.
*B41F 31/20* (2006.01)
*B41F 9/06* (2006.01)
(Continued)

(52) U.S. Cl.
CPC ..... *B41F 13/193* (2013.01); *B41F 9/021* (2013.01); *B41F 9/063* (2013.01); *B41F 31/302* (2013.01); *B41F 31/307* (2013.01); *B41F 33/10* (2013.01); *B41P 2233/11* (2013.01)

(58) Field of Classification Search
CPC ..... B41F 31/302; B41F 31/30; B41F 9/063; B41F 9/021
See application file for complete search history.

(56) References Cited

U.S. PATENT DOCUMENTS 2,425,529 A * 8/1947 Harless ..... B41F 31/302 101/209
5,062,359 A 11/1991 Giori
(Continued)

FOREIGN PATENT DOCUMENTS

EP 1 088 657 4/2001

OTHER PUBLICATIONS

International Search Report for PCT/IB2013/052846, mailed Oct. 14, 2013, 6 pages.
(Continued)

*Primary Examiner* — Matthew G Marini
*Assistant Examiner* — Leo T Hinze
(74) *Attorney, Agent, or Firm* — Nixon & Vanderhye P.C.

(57) ABSTRACT

There is described a printing press (1; 1*; 1) comprising an ink-receiving cylinder (9; 8) receiving ink from an inking system (90-93, 90*, 93*; 95-99, 95*, 99*; 100-104, 100*, 104*) having a plurality of ink-applying cylinders or rollers (93, 93*; 99, 99*; 104, 104*) arranged one above the other around part of a circumference of the ink-receiving cylinder (9; 8), the ink-applying cylinders or rollers (93, 93*; 99, 99*; 104, 104*) being inked by a corresponding plurality of inking devices (90, 90*; 95, 95*; 100, 100*), the printing press (1; 1*; 1**) further comprising an inking carriage (52; 55; 57) supporting the plurality of inking devices (90, 90*; 95, 95*; 100, 100*), which inking carriage (52; 55; 57) can be moved with respect to the ink-receiving cylinder (9; 8) between a working position and a retracted position. The at least one selected inking device (90*; 95*; 100*) amongst the plurality of inking devices (90, 90*; 95, 95*; 100, 100*) of the inking system (90-93, 90*, 93*; 95-99, 95*, 99*; 100-104, 100*, 104*) is supported onto the inking carriage (52; 55; 57) via a movable frame (60; 65; 70), which movable frame (60; 65; 70) is supported by the inking carriage (52; 55; 57) to allow movement of the selected inking device (90*; 95*; 100*) with respect to the inking carriage (52; 55; 57) and with respect to a remaining part (90; 95; 100) of the plurality of inking devices (90, 90*; 95, 95*; 100, 100***).

15 Claims, 12 Drawing Sheets

(51) Int. Cl.

| | |
|---|---|
| ***B41F 13/193*** | (2006.01) |
| ***B41F 31/30*** | (2006.01) |
| ***B41F 33/10*** | (2006.01) |
| ***B41F 9/02*** | (2006.01) |

(56) References Cited

U.S. PATENT DOCUMENTS

| | | | | |
|---|---|---|---|---|
| 5,062,360 | A | 11/1991 | Germann et al. | |
| 5,282,417 | A | 2/1994 | Germann | |
| 5,899,145 | A * | 5/1999 | Schaede | B41F 9/02 101/152 |
| 6,101,939 | A | 8/2000 | Giori et al. | |
| 6,111,261 | A | 8/2000 | Bolza-Schunemann et al. | |
| 6,176,482 | B1 | 1/2001 | Reinhard et al. | |
| 7,011,020 | B2 | 3/2006 | Dunninger et al. | |
| 7,124,682 | B2 * | 10/2006 | Aoki | B41F 9/1018 101/152 |
| 8,065,957 | B2 | 11/2011 | Schaede et al. | |
| 8,231,125 | B2 | 7/2012 | Hendle et al. | |
| 8,516,960 | B2 | 8/2013 | Bollettin et al. | |
| 8,528,477 | B2 | 9/2013 | Schaede et al. | |
| 8,794,141 | B2 | 8/2014 | Schaede | |
| 8,939,078 | B2 * | 1/2015 | Kamoda | B41F 33/02 101/169 |
| 2004/0237816 | A1 | 12/2004 | Dunninger et al. | |
| 2005/0127595 | A1 | 6/2005 | Hendle et al. | |
| 2006/0144265 | A1 | 7/2006 | Dunninger et al. | |
| 2008/0271620 | A1 | 11/2008 | Hoier et al. | |
| 2009/0007807 | A1 * | 1/2009 | Schaede | B41F 33/0036 101/242 |
| 2009/0025594 | A1 | 1/2009 | Schaede et al. | |
| 2009/0096156 | A1 | 4/2009 | Hendle et al. | |
| 2009/0183644 | A1 | 7/2009 | Bollettin et al. | |
| 2010/0139511 | A1 | 6/2010 | Schaede | |
| 2012/0312179 | A1 | 12/2012 | Scheade et al. | |
| 2012/0312180 | A1 | 12/2012 | Scheade et al. | |
| 2013/0112095 | A1 | 5/2013 | Schaede et al. | |
| 2014/0218502 | A1 | 8/2014 | Schaede et al. | |
| 2014/0338549 | A1 | 11/2014 | Schaede | |

OTHER PUBLICATIONS

Written Opinion for PCT/IB2013/052846, mailed Oct. 14, 2013, 7 pages.

* cited by examiner

PRINTING PRESS WITH MOBILE INKING CARRIAGE

This application is the U.S. national phase of International Application No. PCT/IB2013/052846, filed 10 Apr. 2013, which designated the U.S. and claims priority to EP Application No. 12163548.6, filed 10 Apr. 2012, the entire contents of each of which are hereby incorporated by reference.

TECHNICAL FIELD

The present invention generally relates to a printing press comprising an ink-receiving cylinder receiving ink from an inking system having a plurality of ink-applying cylinders or rollers arranged one above the other around part of a circumference of the ink-receiving cylinder, the ink-applying cylinders or rollers being inked by a corresponding plurality of inking devices, the printing press further comprising an inking carriage supporting the plurality of inking devices, which inking carriage can be moved with respect to the ink-receiving cylinder between a working position and a retracted position. More precisely, the present invention relates to such a printing press, especially an intaglio printing press, which is in particular used for the production of banknotes and like security documents.

BACKGROUND OF THE INVENTION

Printing presses of the above-mentioned type are already known in the art, for instance from Swiss Patent No. CH 685 380 A5, European Patent Publications Nos. EP 0 406 157 A1, EP 0 415 881 A2, EP 0 563 007 A1, EP 0 873 866 A1, and International Publications Nos. WO 03/047862 A1, WO 2008/146193 A1, WO 2011/077348 A1, WO 2011/077350 A1, WO 2011/077351 A1, all assigned to the instant Applicant.

In the above printing presses, a problem may arise in respect of the accessibility of part of the inking devices, in particular of the uppermost and lowermost inking devices. It may in particular be difficult for an operator to perform setting-up, inspection and maintenance operations of the lowermost inking device which is typically hidden by the inking device that is located immediately above it.

An attempt to solve this problem is disclosed in European Patent Publication No. EP 1 088 657 A1. This publication more precisely discloses an intaglio printing press with four chablon cylinders acting as ink-applying cylinders and a corresponding number of inking devices, wherein the lowermost inking device and associated chablon cylinder are supported by a first sub-frame capable of moving toward and away from a main frame supporting the ink-receiving cylinder (namely an intaglio cylinder or an ink-collecting cylinder of the intaglio printing press). The three remaining inking devices (i.e. the inking devices other than the inking device that is supported by the first sub-frame) are supported by a second sub-frame, distinct and independent from the first sub-frame, which is also capable of moving towards and away from the main frame. In addition, the three remaining chablon cylinders (i.e. the chablon cylinders other than the chablon cylinder that is supported by the first sub-frame) are supported by the main frame or, as the case may be, by the second sub-frame.

A problem with the solution described in European Patent Publication No. EP 1 088 657 A1 resides in the fact that the first sub-frame not only supports the lowermost inking device, but also the associated, lowermost chablon cylinder. This is not ideal from the point of view of the register accuracy between the chablon cylinder and the ink-receiving cylinder with which the chablon cylinder cooperates, and one rather prefers to support all chablon cylinders within the same frame as the ink-receiving cylinder. This furthermore unnecessarily complicates the driving interconnection between the chablon cylinder and the ink-receiving cylinder.

A further problem with the solution described in European Patent Publication No. EP 1 088 657 A1 resides in the fact that the first sub-frame can be moved to its retracted position only after the second sub-frame has been moved to its retracted position. This means that setting-up and inspection operations of the lowermost inking device specifically require the other inking devices to be retracted by moving the second sub-frame to its retracted position (as shown in FIG. 2(b) of EP 1 088 657 A1), which unnecessarily complicates setting-up, inspection and maintenance operations.

An improved solution is thus required.

SUMMARY OF THE INVENTION

A general aim of the invention is therefore to provide an improved printing press of the type comprising an inking carriage as discussed in the preamble hereof.

A further aim of the invention is to provide such a printing press that facilitates setting-up, inspection and maintenance operations.

Yet another aim of the invention is to provide such a printing press that allows an operator to get easy and improved access to all inking devices, including the inking device that is located at the lowermost position.

These aims are achieved thanks to the printing press defined in the claims.

There is accordingly provided a printing press comprising an ink-receiving cylinder receiving ink from an inking system having a plurality of ink-applying cylinders or rollers arranged one above the other around part of a circumference of the ink-receiving cylinder, the ink-applying cylinders or rollers being inked by a corresponding plurality of inking devices, the printing press further comprising an inking carriage supporting the plurality of inking devices, which inking carriage can be moved with respect to the ink-receiving cylinder between a working position and a retracted position. According to the invention, at least one selected inking device amongst the plurality of inking devices of the inking system is supported onto the inking carriage via a movable frame, which movable frame is supported by the inking carriage to allow movement of the selected inking device with respect to the inking carriage and with respect to a remaining part of the plurality of inking devices.

Such a printing press greatly facilitates setting-up, inspection and maintenance operations in that the selected inking device can be moved to a retracted position by operating the movable frame that supports the selected inking device onto the inking carriage, irrespective of the actual position of the inking carriage.

In accordance with a preferred embodiment of the invention, the movable frame is movable between an operating position where the selected inking device can cooperate, in the working position of the inking carriage, with a corresponding one of the ink-applying cylinders or rollers and a pulled-back position where the selected inking device is retracted away from the remaining part of the plurality of inking devices. In this context, displacement of the movable frame between the operating position and pulled-back position advantageously occurs by translation, preferably along a horizontal plane.

Preferably, the selected inking device is an inking device amongst the plurality of inking devices that is located at a lowermost position.

In a preferred embodiment, the ink-applying cylinders or rollers are located together with the ink-receiving cylinder in a supporting frame of the printing press, the inking carriage being moved away from the ink-applying cylinders or rollers and the ink-receiving cylinder in the retracted position. In this context, the supporting frame can be a stationary frame of the printing press or an intermediate carriage located between the inking carriage and a stationary frame of the printing press.

The inking carriage is advantageously suspended under supporting rails.

According to a preferred variant of the invention, the printing press is an intaglio printing press. In that respect, the ink-applying cylinders or rollers can be chablon cylinders applying ink directly onto a circumference of an ink-collecting cylinder or an intaglio cylinder of the intaglio printing press. Alternatively, the ink-applying cylinders or rollers can be chablon cylinders, the selected inking device inking a selected one of the chablon cylinders which applies ink directly onto a circumference of a plate-cylinder of the intaglio printing press, while a remaining part of the chablon cylinders apply ink directly onto a circumference of an ink-collecting cylinder of the intaglio printing press.

Advantageously, the movable frame can be allowed to move in both the working position and retracted position of the inking carriage.

In yet another embodiment of the invention, a reflective panel is provided at an upper location above an uppermost one of the plurality of inking devices, which reflective panel is disposed in such a way as to allow an operator to visually inspect the uppermost inking device by reflection onto the reflective panel.

Further advantageous embodiments of the printing press form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The present invention will be described in the particular context of the application to an intaglio printing press as used for the production of banknotes and like security documents. It should however be appreciated that the invention is also applicable to printing presses other than intaglio printing presses which could similarly be characterized by an arrangement of multiple ink-applying cylinders one above the other (together with their associated inking devices) around part of the circumference of an ink-receiving cylinder.

Within the scope of the present invention, the expression "intaglio cylinder" designates either a cylinder whose surface is provided with intaglio patterns engraved directly onto the circumference of the cylinder or a plate cylinder carrying on its circumference at least one intaglio printing plate with engraved intaglio patterns (the second solution being now more common in the art). In the following description, it will be assumed for the sake of illustration that the intaglio cylinder is a plate cylinder carrying several intaglio printing plates on its circumference. Similarly, the expression "chablon cylinder" (which is equivalent to the expression "colour-selector cylinder" also used in the art) is to be understood as designating a cylinder with raised portions whose purpose is to selectively transfer ink patterns to the circumference of a downstream-located ink-receiving cylinder. Furthermore, the expression "ink-collecting cylinder" designates within the scope of the present invention a cylinder whose purpose is to collect inks from multiple chablon cylinders (which have been inked by associated inking devices) before transferring the resulting multicolour pattern of inks onto the intaglio cylinder. In the art of intaglio printing, the expression "Orlof cylinder" is also typically used as an equivalent to the expression "ink-collecting cylinder".

Figure 1:
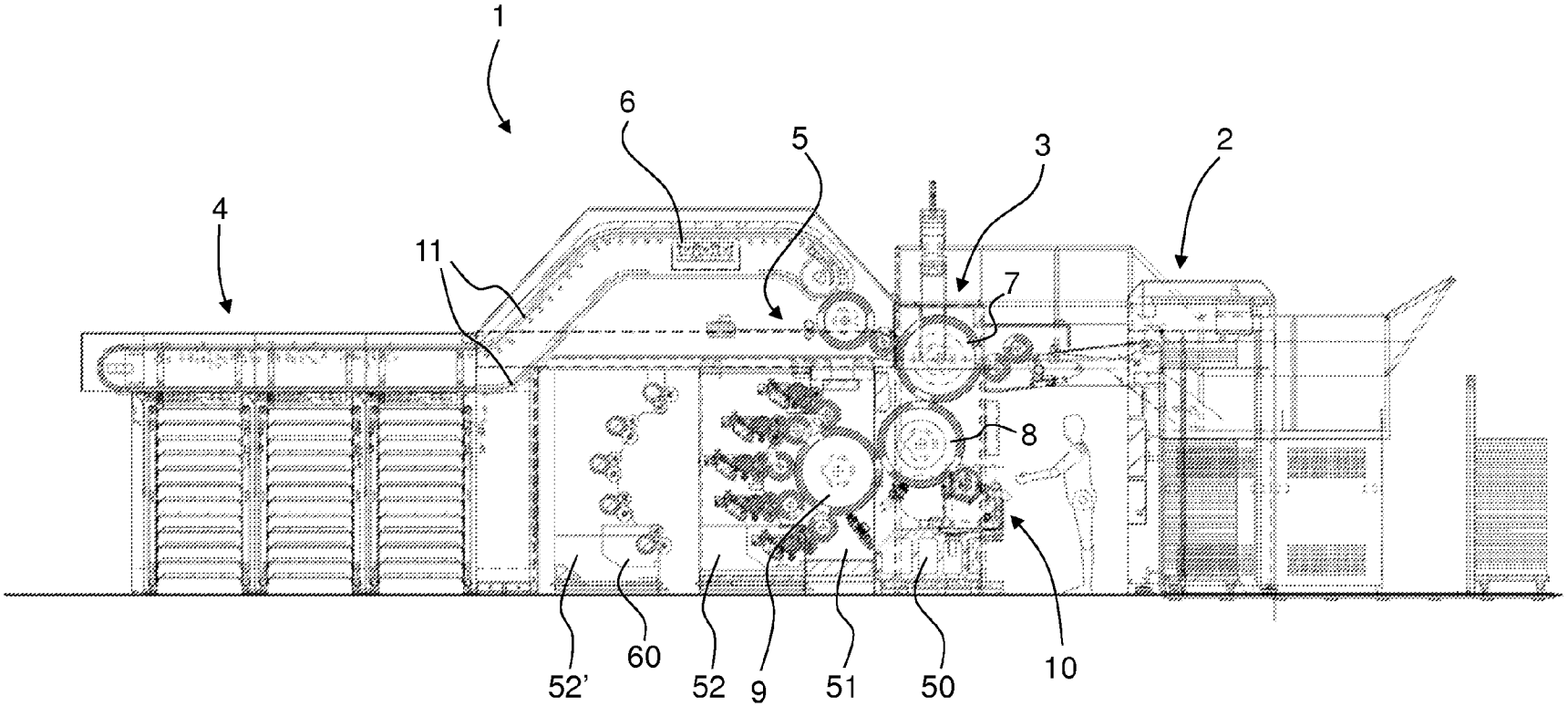
FIG. 1 is a side-view of an intaglio printing press according to a first embodiment of the invention.
Figure 2:
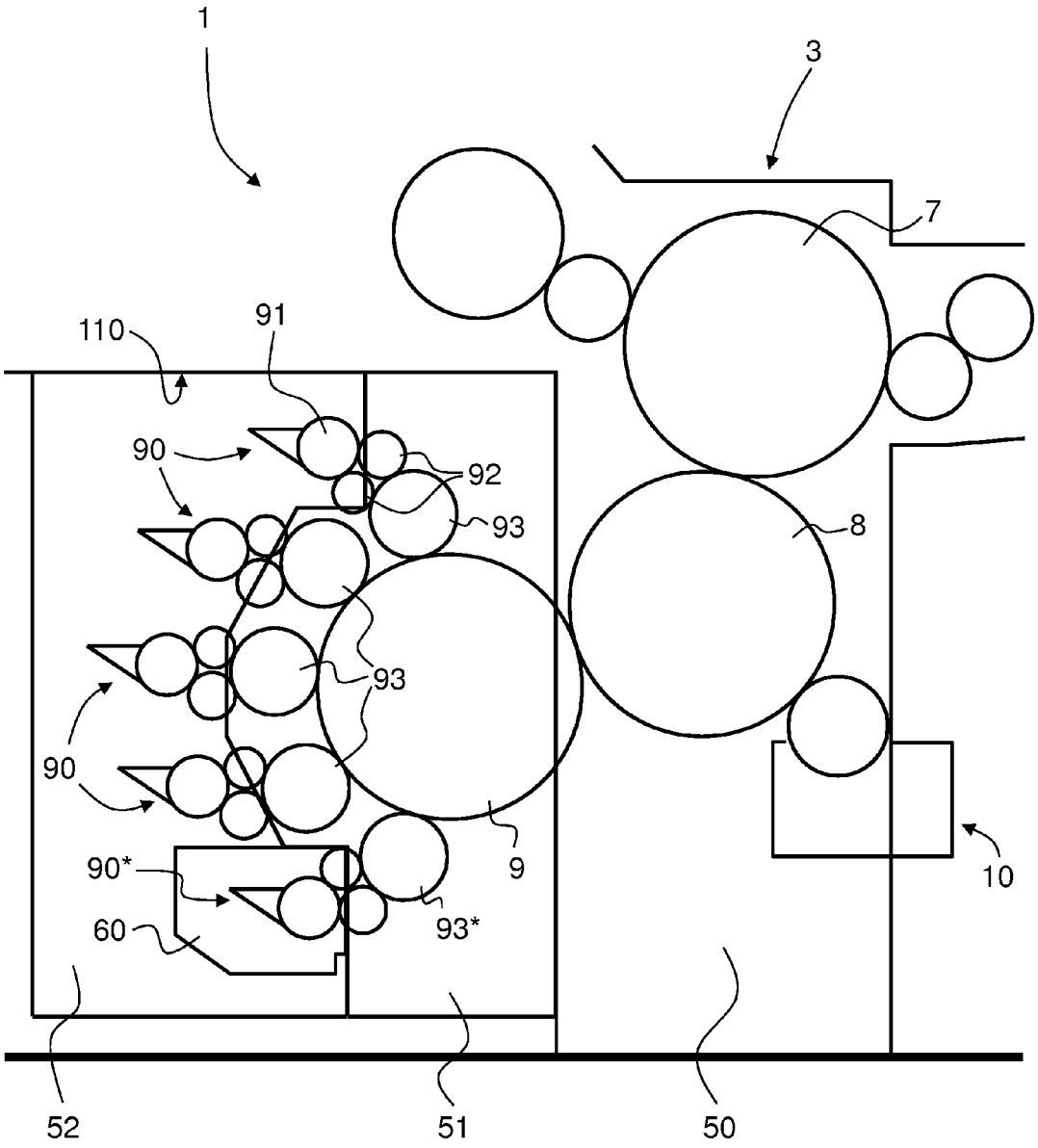
FIG. 2 is an enlarged schematic side view of the printing unit of the intaglio printing press of FIG. 1.

FIGS. 1 and 2 schematically illustrate an intaglio printing press according to a first embodiment of the invention, which printing press is generally designated by reference numeral 1.

More precisely, FIG. 1 shows a sheet-fed intaglio printing press 1 comprising a sheet feeder 2 for feeding sheets to be printed, an intaglio printing unit 3 for printing the sheets, and a sheet delivery unit 4 for collecting the freshly-printed sheets. The intaglio printing unit 3 includes an impression cylinder 7, an intaglio cylinder 8 (in this example, the intaglio cylinder 8 is a three-segment plate cylinder carrying three intaglio printing plates), an inking system comprising an ink-collecting cylinder, or Orlof cylinder, 9 (here a three-segment blanket cylinder carrying a corresponding number of blankets) for inking the surface of the intaglio printing plates carried by the intaglio cylinder 8 and an ink wiping system 10 for wiping the inked surface of the intaglio printing plates carried by the intaglio cylinder 8 prior to printing of the sheets.

The sheets are fed from the sheet feeder 2 onto a feeder table and then onto the impression cylinder 7. The sheets are then carried by the impression cylinder 7 to the printing nip between the impression cylinder 7 and the intaglio cylinder 8 where intaglio printing is performed. Once printed, the sheets are transferred away from the impression cylinder 7 for conveyance by a sheet transporting system 11 in order to be delivered to the delivery unit 4. The sheet transporting system 11 conventionally comprises a sheet conveyor system with a pair of endless chains driving a plurality of spaced-apart gripper bars for holding a leading edge of the sheets (the freshly-printed side of the sheets being oriented downwards on their way to the delivery unit 4), sheets being transferred in succession to a corresponding one of the gripper bars.

During their transport to the sheet delivery unit 4, the freshly printed sheets are preferably inspected by an optical inspection system 5. In the illustrated example, the optical inspection system 5 is advantageously an inspection system as disclosed in International Publication No. WO 2011/161656 A1 (which publication is incorporated herein by reference in its entirety), which inspection system 5 comprises a transfer mechanism and an inspection drum located at the transfer section between the impression cylinder 7 and chain wheels of the sheet transporting system 11. The optical inspection system 5 could alternatively be an inspection system placed along the path of the sheet transporting system 11 as described in International Publications Nos. WO 97/36813 A1, WO 97/37329 A1, and WO 03/070465 A1. Such inspection systems are in particular marketed by the Applicant under the product designation NotaSave®.

Before delivery, the printed sheets are preferably transported in front of a drying or curing unit 6 disposed after the inspection system 5 along the transport path of the sheet transporting system 11. Drying or curing could possibly be performed prior to the optical inspection of the sheets.

FIG. 2 is a schematic view of the intaglio printing unit 3 of the intaglio printing press 1 of FIG. 1. As already mentioned, the intaglio printing unit 3 basically includes the impression cylinder 7, the intaglio cylinder 8 with its intaglio printing plates, the inking system with its ink-collecting cylinder 9, and the ink wiping system 10.

The inking system comprises in this example five inking devices, all of which cooperate with the ink-collecting cylinder 9 that contacts the intaglio cylinder 8. For the sake of distinction, the lowermost inking device is designated by reference numeral 90*, while the remaining (four) inking devices are designated by reference numeral 90. It will be understood that the illustrated inking system is adapted for indirect inking of the intaglio cylinder 8, i.e. inking of the intaglio printing plates via the ink-collecting cylinder 9. The inking devices 90, 90* each include an ink duct 91 cooperating in this example with a pair of ink-application rollers 92. Each pair of ink-application rollers 92 in turn inks a corresponding chablon cylinder 93, 93* which is in contact with the ink-collecting cylinder 9. Reference numeral 93* designates the lowermost chablon cylinder, whereas reference numeral 93 designate the remaining (four) upper-located chablon cylinders. As is usual in the art, the surface of the chablon cylinders 93, 93* is structured so as to exhibit raised portions corresponding to the areas of the intaglio printing plates intended to receive the inks in the corresponding colours supplied by the respective inking devices 90, 90*.

As shown in FIGS. 1 and 2, the impression cylinder 7 and intaglio cylinder 8 are both supported by a stationary (main) frame 50 of the printing press 1. The inking devices 90, 90* (including the ink duct 91 and ink-application rollers 92) are supported in a mobile inking carriage 52, while the ink-collecting cylinder 9 and chablon cylinder 93, 93* are supported in an intermediate carriage 51 located between the inking carriage 52 and the stationary frame 50. Both the inking carriage 51 and the intermediate carriage 52 are advantageously suspended under supporting rails.

The ink wiping system 10, on the other hand, typically comprises a wiping tank, a wiping roller assembly supported on and partly located in the wiping tank and contacting the intaglio cylinder 8, cleaning means for removing wiped ink residues from the surface of the wiping roller assembly using a wiping solution that is sprayed or otherwise applied onto the surface of the wiping roller assembly, and a drying blade contacting the surface of the wiping roller assembly for removing wiping solution residues from the surface of the wiping roller assembly. A particularly suitable solution for the ink wiping system 10 is disclosed in International Publication No. WO 2007/116353 A1 which is incorporated herein by reference in its entirety.

Figure 3A:
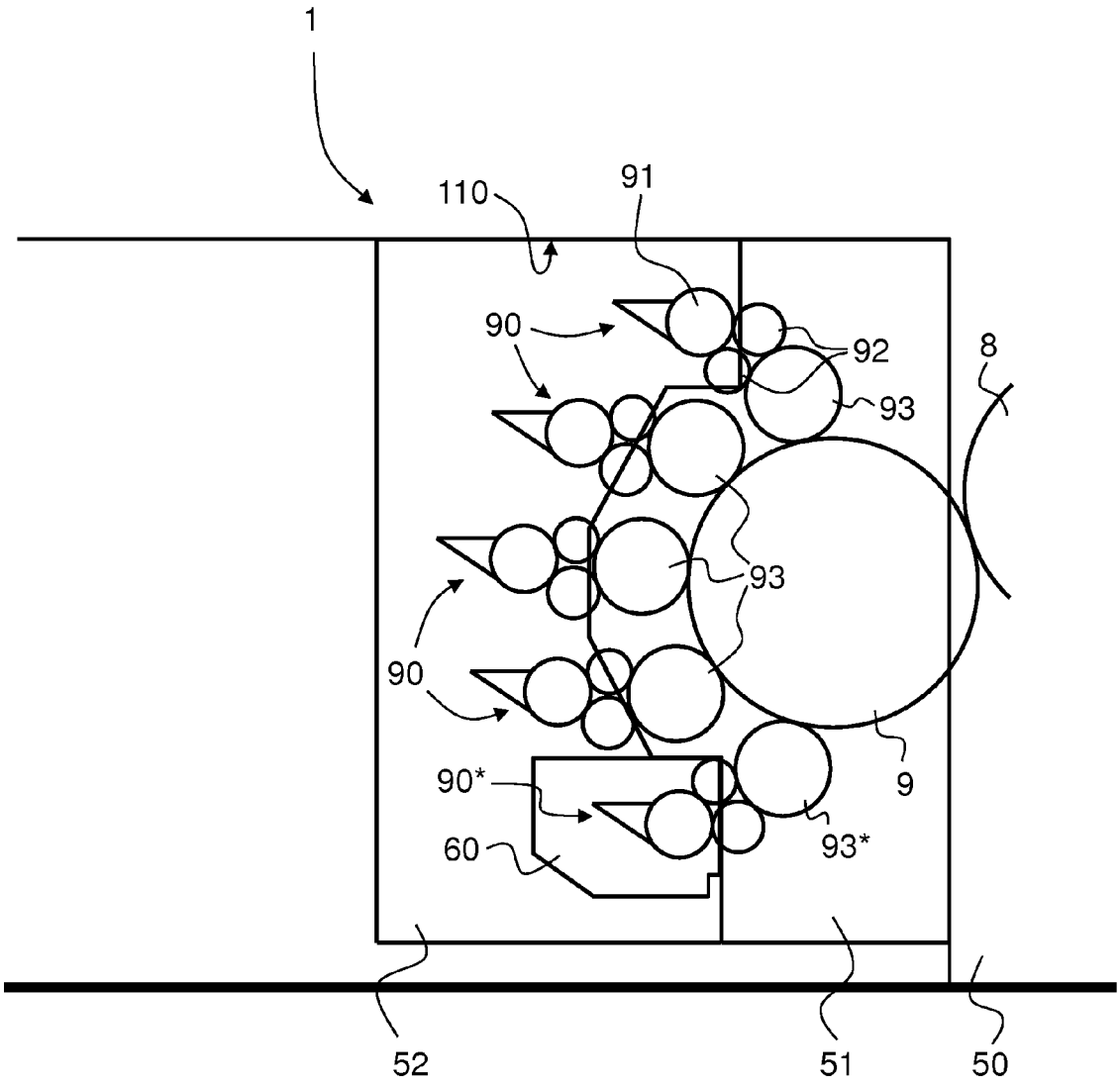
FIGS. 3*a* to 3*d* are schematic partial side views of the intaglio printing press of FIG. 1 illustrating possible positions of an inking carriage and of an intermediate carriage of the intaglio printing press.
Figure 3B:
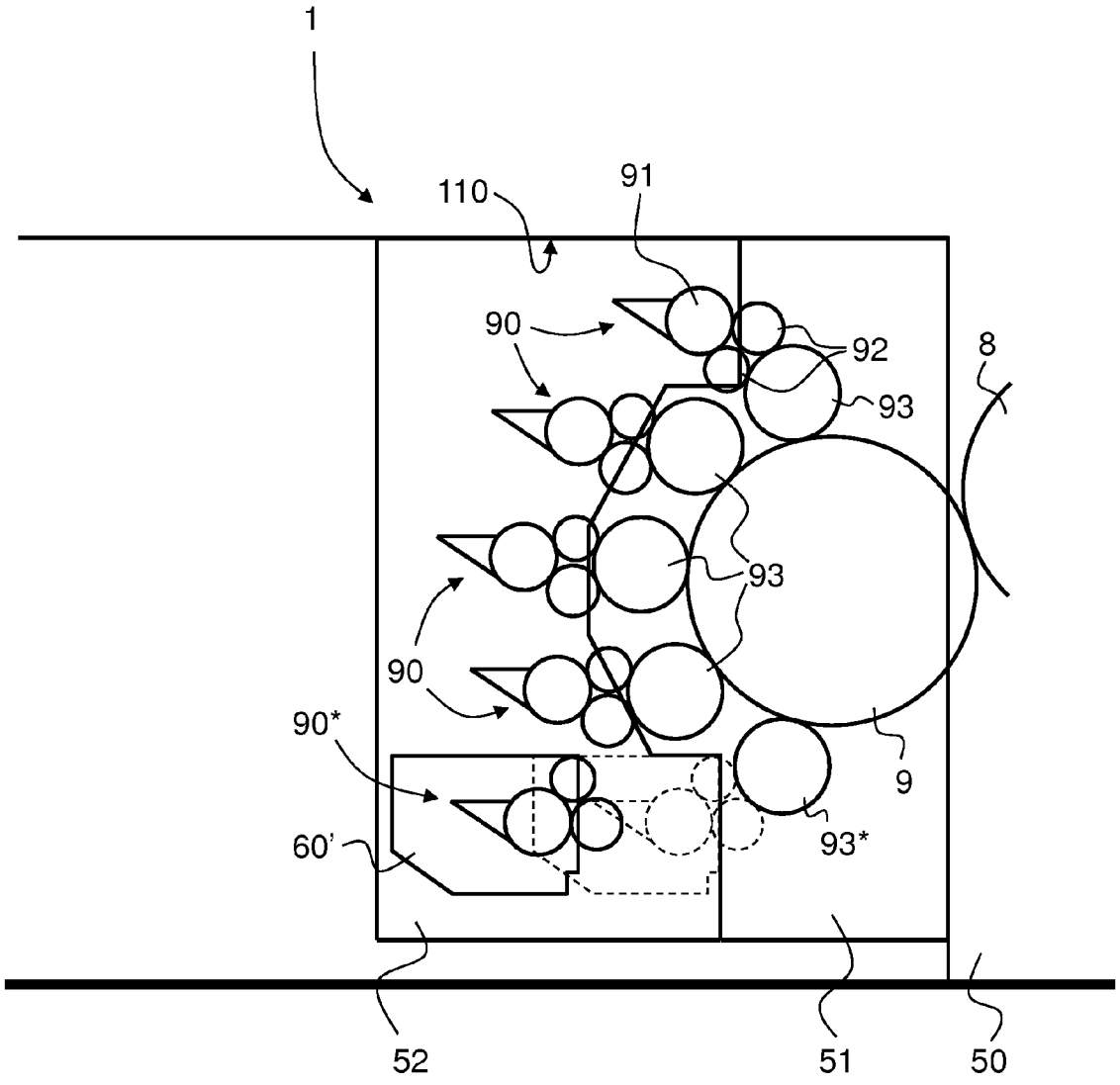
Figure 3C:
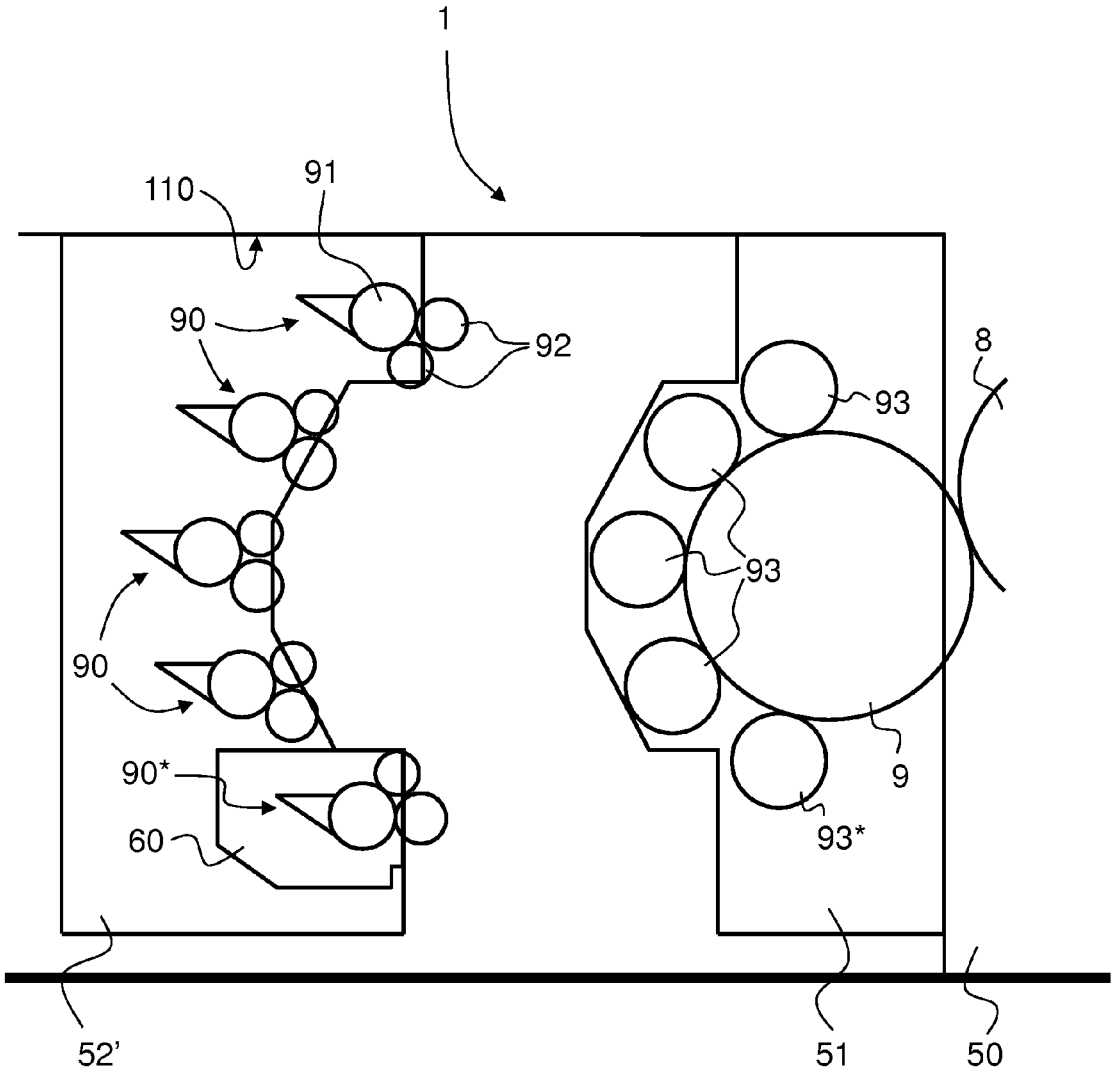
Figure 3D:
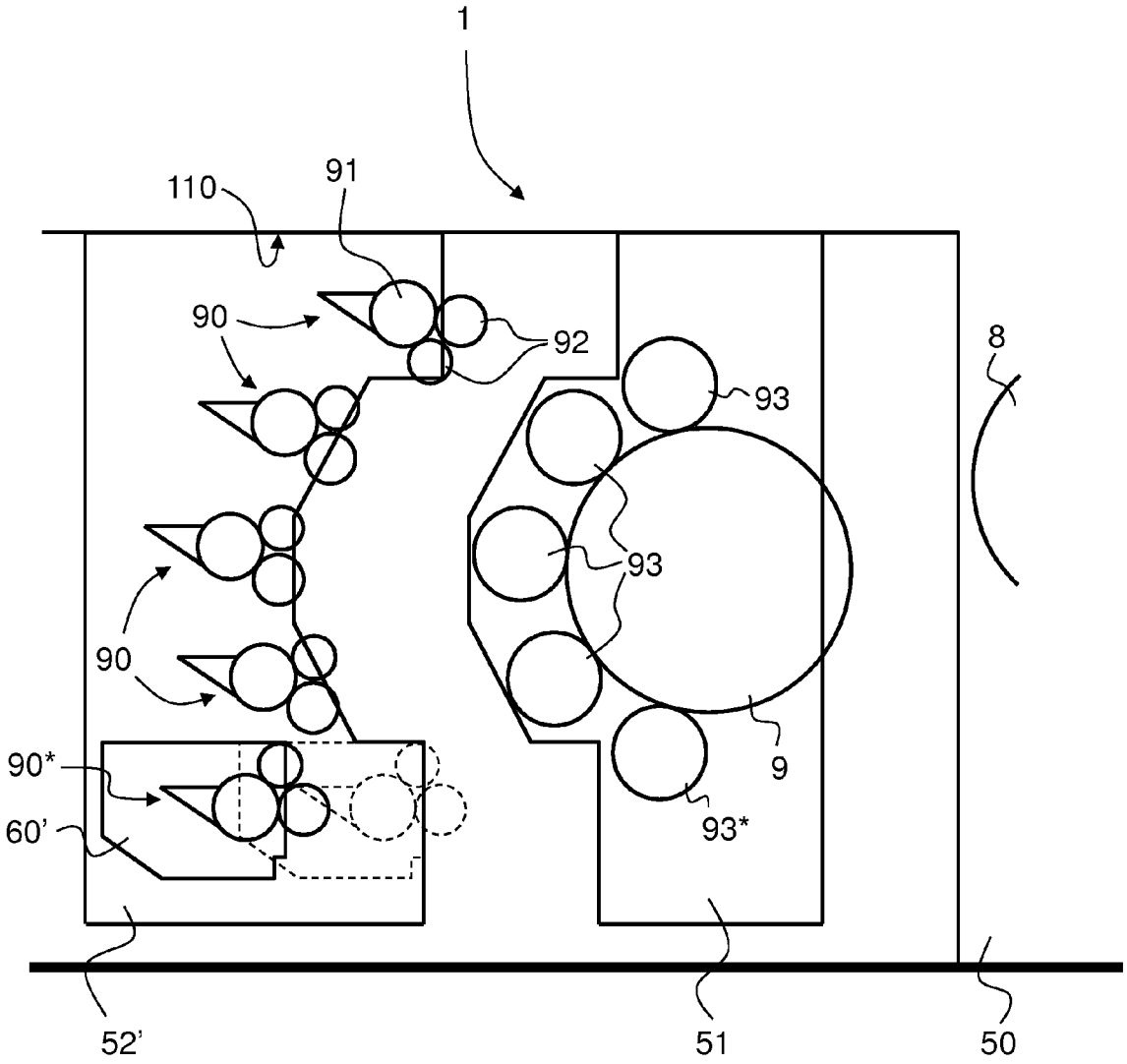

As further shown in FIGS. 1 and 2, a selected one of the inking devices 90, 90*, namely the lowermost inking device 90*, is supported onto a frame 60, which frame 60 is supported by the inking carriage 52, namely between a pair of side frames of the inking carriage 52. As further shown in FIGS. 3*a* and 3*b*, the frame 60 is supported by the inking carriage 52 so as to be movable and allow movement of the inking device 90* with respect to the inking carriage 52 and with respect to the other inking devices 90. More precisely, in this embodiment, the movable frame 60 is movable, by translation, between an operating position (as illustrated in FIGS. 1 to 3*a* and 3*c*) where the selected inking device 90* can cooperate, in the working position of the inking carriage 52, with a corresponding one of the chablon cylinders 93, 93*, namely the lowermost chablon cylinder 93*, and a pulled-back position (as illustrated in FIGS. 3*b* and 3*d*) where the lowermost inking device 90* is retracted away from the remaining inking devices 90. In FIGS. 3*b* and 3*d*, the movable frame 60 retracted to its pulled-back position is indicated by reference numeral 60', while the dashed-lines in FIGS. 3*b* and 3*d* indicate the operating position of the movable frame 60. FIGS. 3*c* and 3*d* also show that the frame 60 can be moved in the retracted position of the inking carriage, indicated by reference numeral 52' in the Figures. FIG. 3*d* additionally shows the intermediate carriage 51 being retracted away from the stationary frame 50.

Displacement of the movable frame 60 can be performed by any suitable actuating mechanism such as by way of an adequate servo motor actuating a linear guide mechanism or by way of a suitable pneumatic or hydraulic system.

Figure 4A:
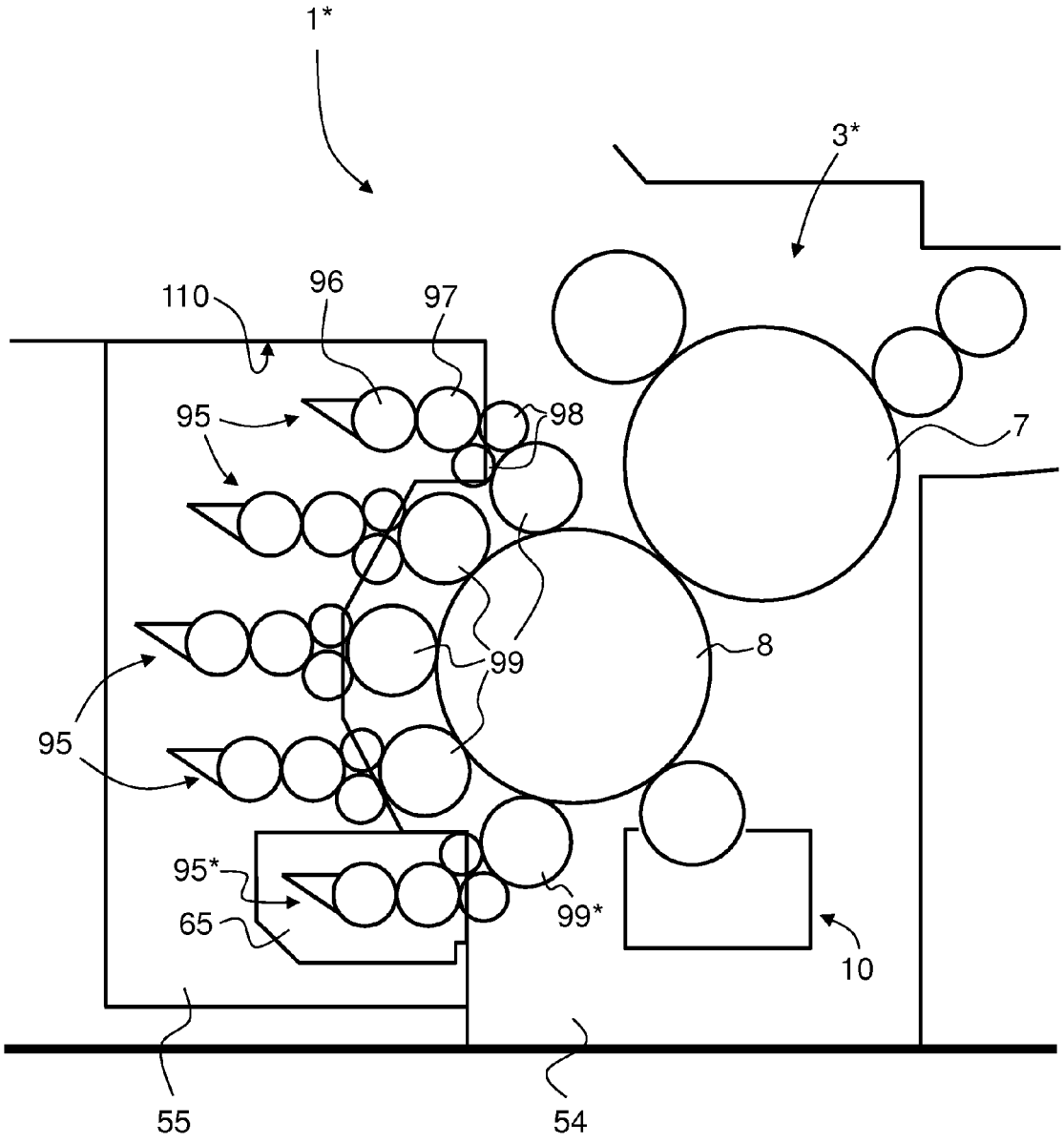
FIGS. 4*a* to 4*c* are schematic partial side views of an intaglio printing press according to a second embodiment of the invention.
Figure 4B:
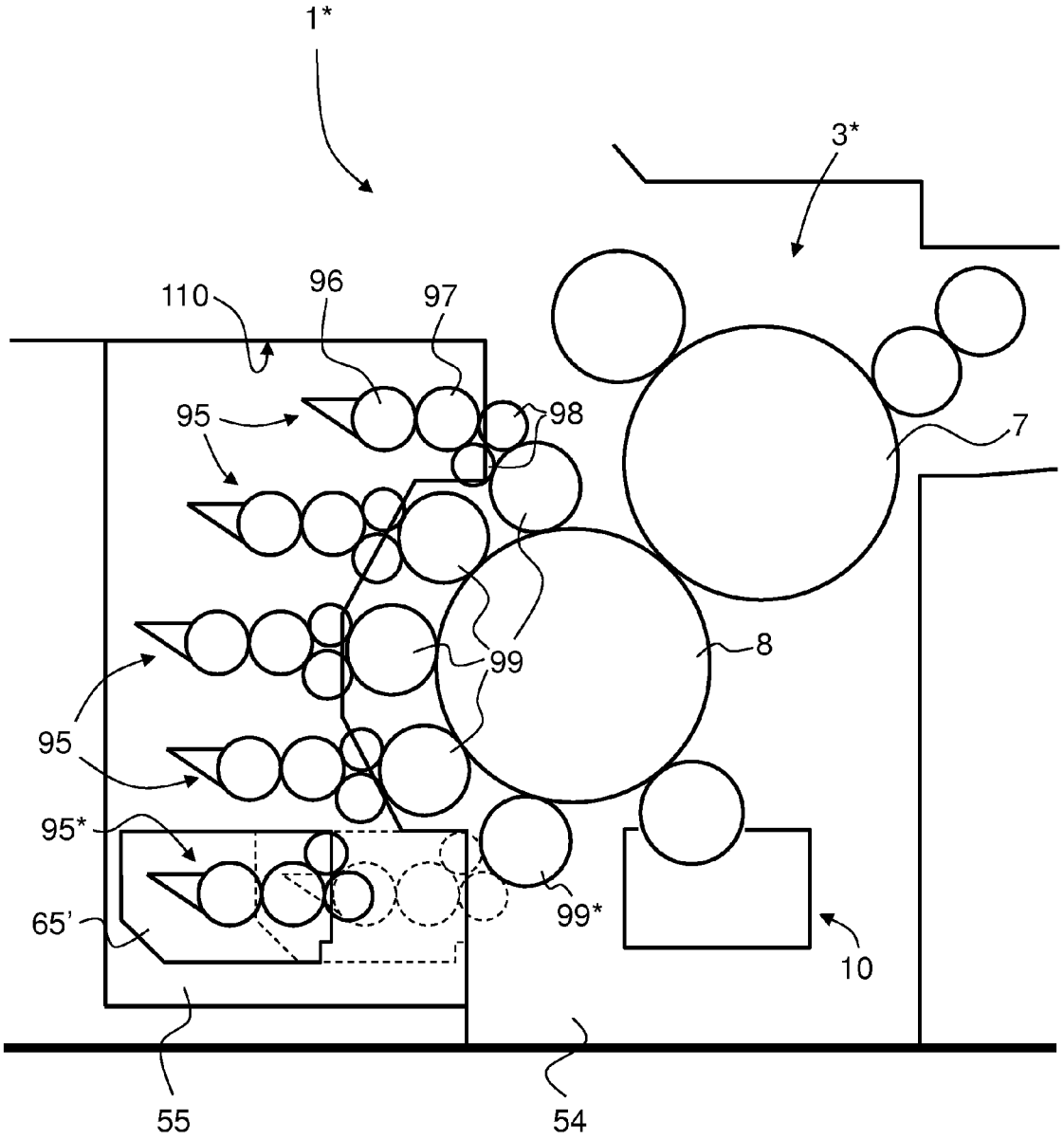
Figure 4C:
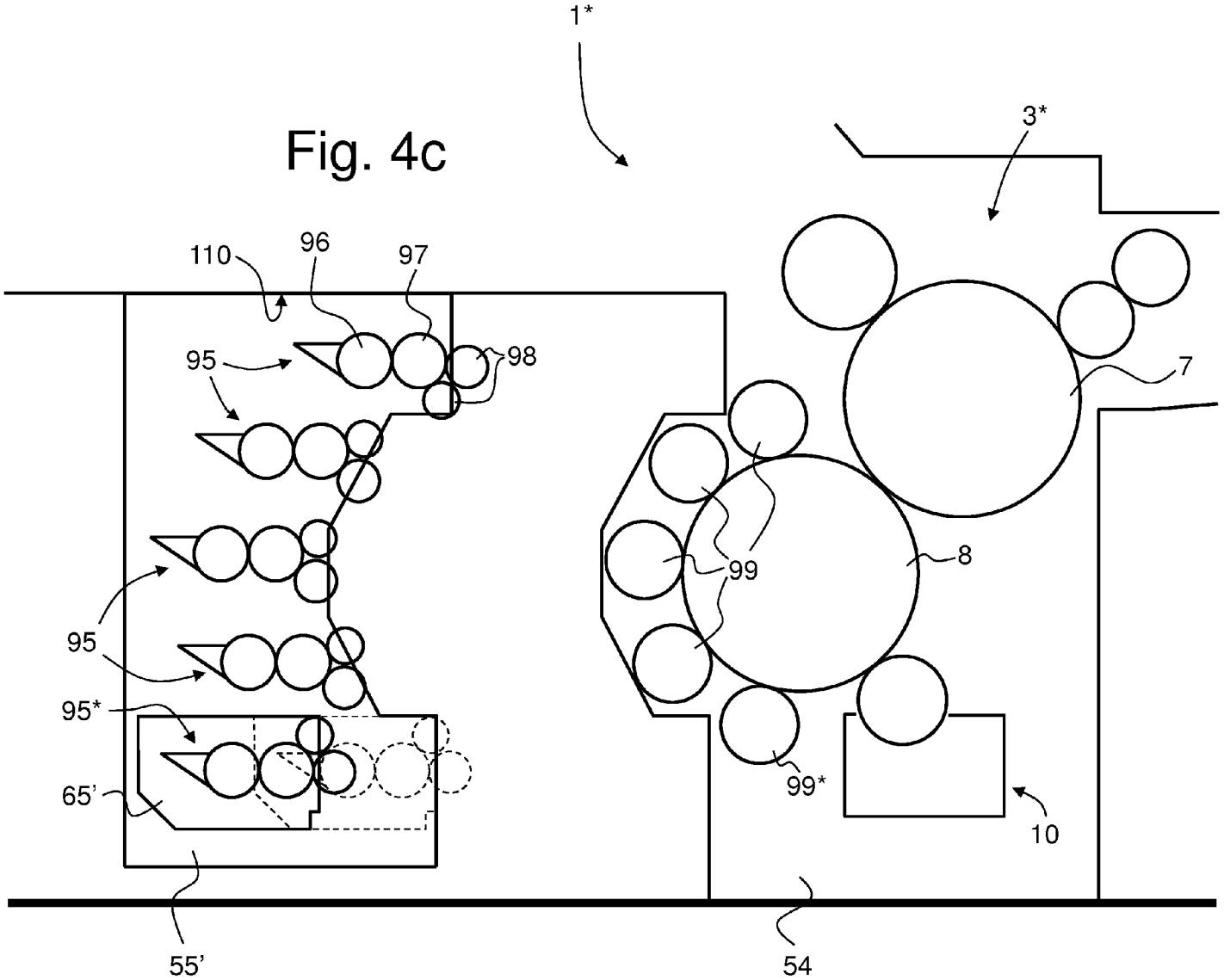

FIGS. 4*a* to 4*c* are schematic partial side views of an intaglio printing press according to a second embodiment of the invention, which intaglio printing press is designated by reference numeral 1*.

In contrast to the first embodiment, the intaglio printing press 1* of FIGS. 4*a* to 4*c* comprises a direct inking system (i.e. without any ink-collecting cylinder), the chablon cylinders, designated by reference numerals 99, 99*, cooperating directly with the intaglio cylinder 8, reference numeral 99* again designating the lowermost chablon cylinder.

The inking devices, designated by reference numerals 95, 95*, each include, in this example, an ink duct 96, an ink-transfer roller 97, and a pair of ink-application rollers 98 adapted to cooperate with the associated chablon cylinder 99, 99*. The inking devices 95, 95* are supported on an inking carriage 55 that is adapted to move between a working position (shown in FIGS. 4*a* and 4*b*) and a retracted position (shown in FIG. 4*c*), the inking carriage being designated by reference numeral 55' in the retracted position. The impression cylinder 7, intaglio cylinder 8, and chablon cylinders 99, 99* are all supported in a stationary frame 54 of the intaglio printing press 1*.

As in the first embodiment, the lowermost inking device 95* is supported onto a movable frame 65 which is supported by the inking carriage 55 (between a pair of side frames of the inking carriage 55) to allow movement of the inking device 95* with respect to the inking carriage 55 and with respect to the other inking devices 95. The movable frame 65 is likewise movable by translation between an operating position (as illustrated in FIG. 4*a*) where the lowermost inking device 95* can cooperate, in the working position of the inking carriage 55, with the lowermost chablon cylinder 99*, and a pulled-back position (as illustrated in FIGS. 4*b* and 4*c*) where the lowermost inking device 95* is retracted away from the remaining inking devices 95. In FIGS. 4*b* and 4*c*, the movable frame 65 retracted to its pulled-back position is indicated by reference numeral 65', while the dashed-lines in FIGS. 4*b* and 4*c* indicate the operating position of the movable frame 65. FIG. 4*c* also shows that the frame 65 can be moved in the retracted position of the inking carriage.

Figure 5A:
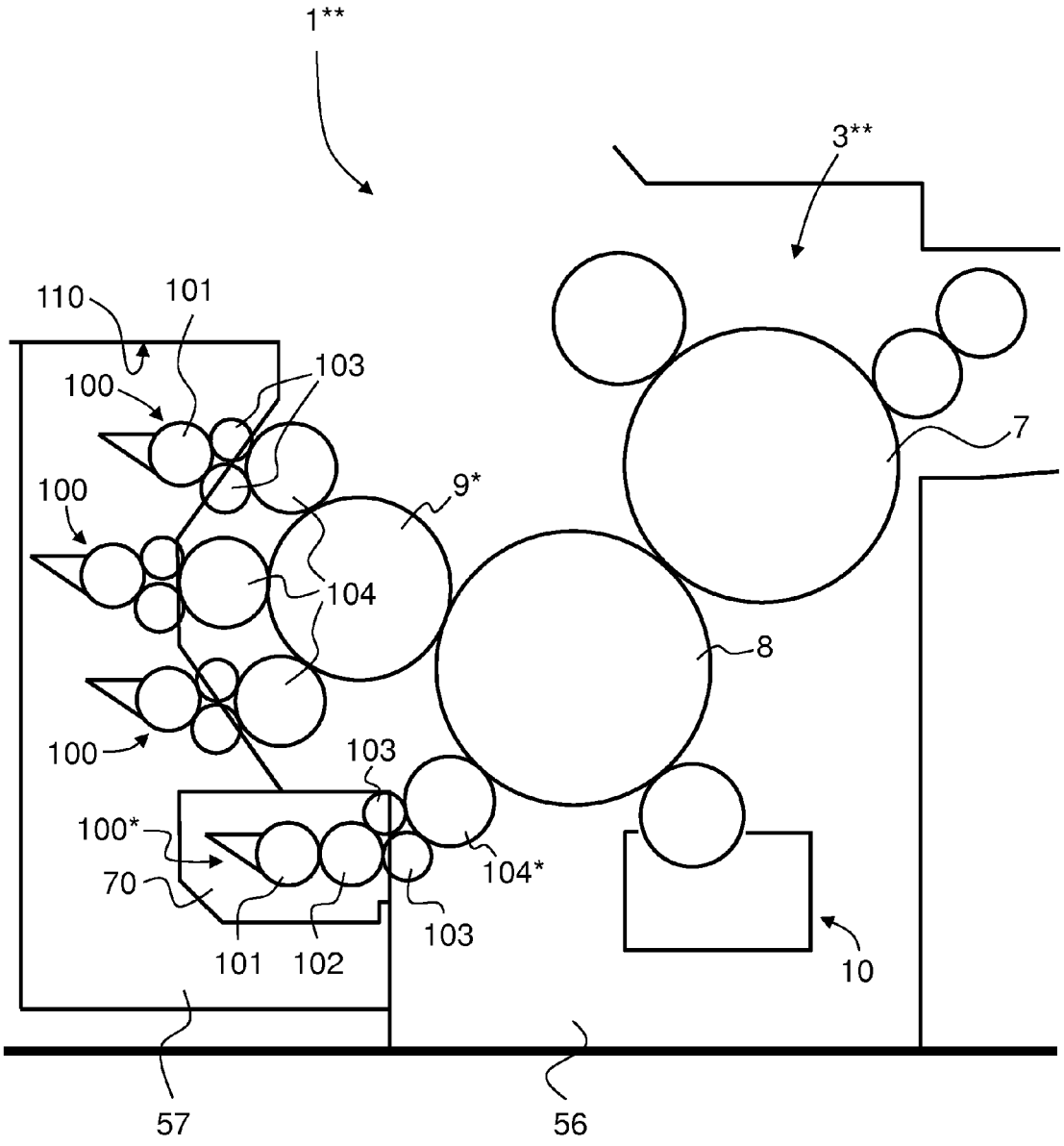
FIGS. 5*a* to 5*c* are schematic partial side views of an intaglio printing press according to a third embodiment of the invention.
Figure 5B:
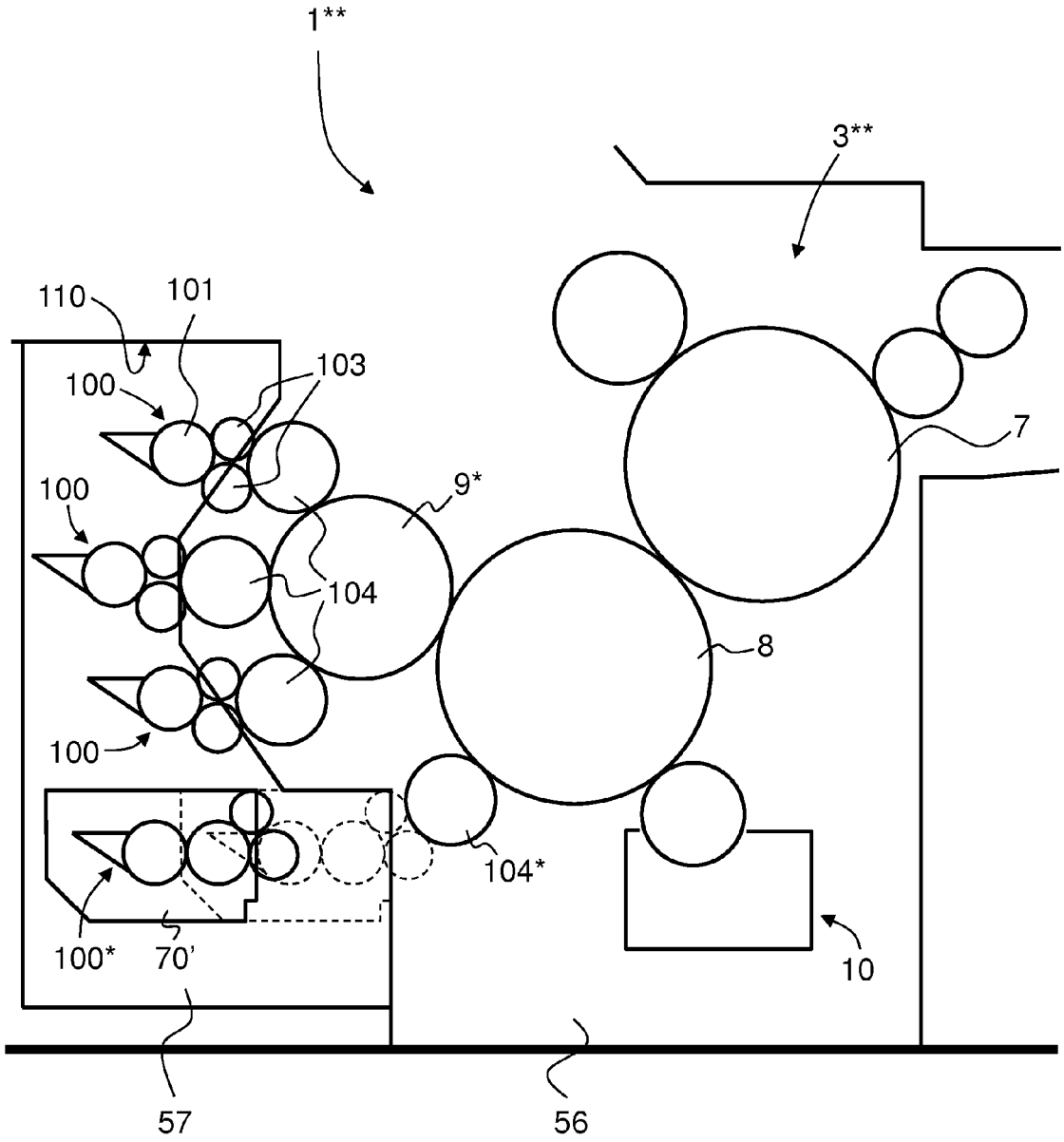
Figure 5C:
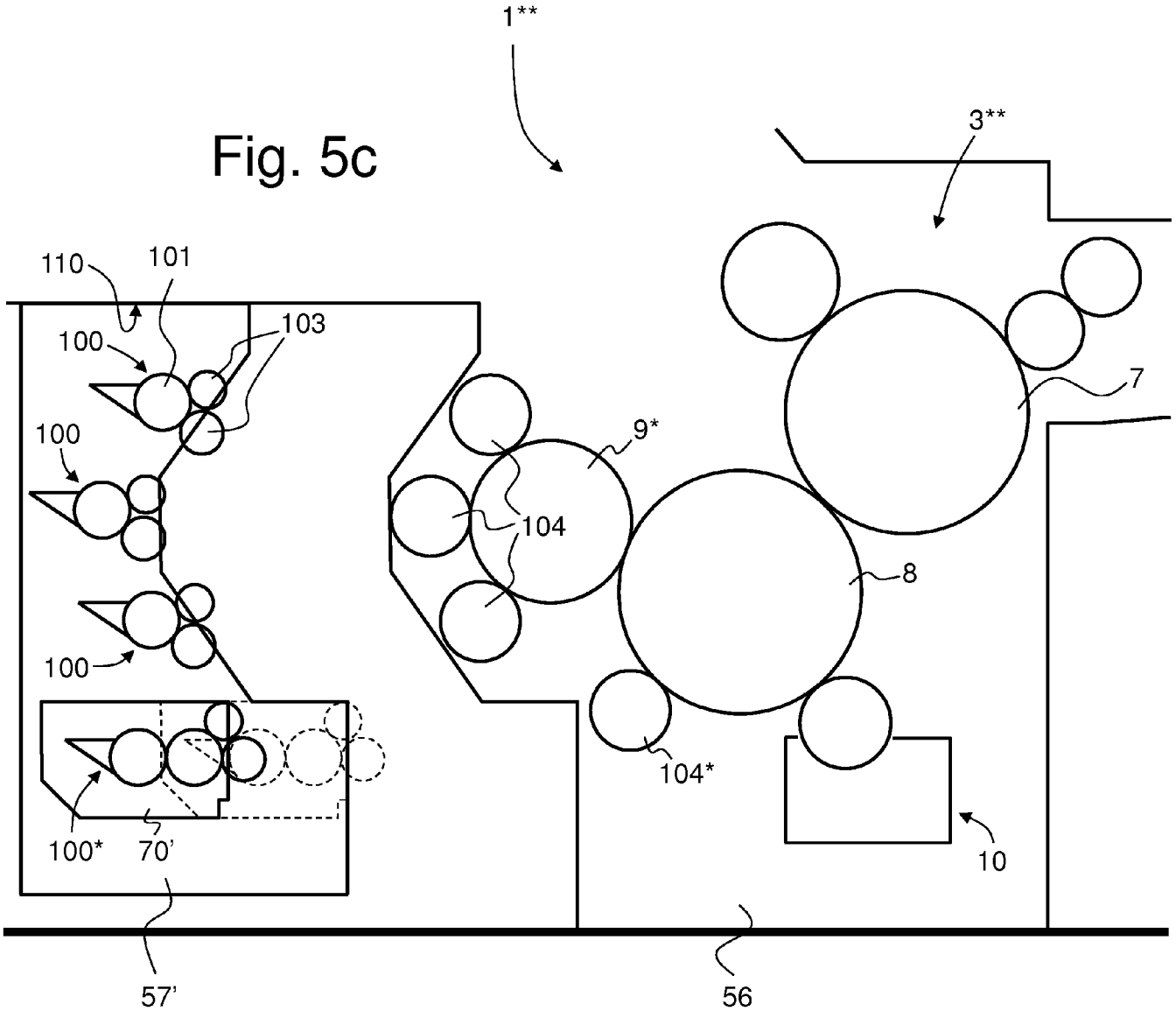

FIGS. 5*a* to 5*c* are schematic partial side views of an intaglio printing press according to a third embodiment of the invention, which intaglio printing press is designated by reference numeral 1**.

In contrast to the first and second embodiments, the intaglio printing press 1 of FIGS. 5***a* to 5*c* comprises a combined direct and indirect inking system and four chablon cylinders 104, 104*. The upper three chablon cylinders 104 cooperate with a two-segment ink-collecting cylinder 9*, while the lowermost chablon cylinder 104* cooperates directly with the intaglio cylinder 8.

The inking devices, designated by reference numerals 100, 100*, include, as far as the upper three inking devices 100 are concerned, an ink duct 101, and a pair of ink-application rollers 103 adapted to cooperate with the associated chablon cylinder 104. As regards the fourth, lowermost inking device 100*, it comprises, in addition to the ink duct 101 and pair of ink-application rollers 103, an ink-transfer roller 102 located between the ink duct 101 and the pair of ink-application rollers 103. The inking devices 100, 100* are likewise supported on an inking carriage 57 that is adapted to move between a working position (shown in FIGS. 5*a* and 5*b*) and a retracted position (shown in FIG. 5*c*), the inking carriage being designated by reference numeral 57' in the retracted position. The impression cylinder 7, intaglio cylinder 8, ink-collecting cylinder 9*, and chablon cylinders 104, 104* are all supported in a stationary frame 56 of the intaglio printing press 1**.

As in the first and second embodiments, the lowermost inking device 104* is supported onto a movable frame 70 which is supported by the inking carriage 57 (between a pair of side frames of the inking carriage 57) to allow movement of the inking device 100* with respect to the inking carriage 57 and with respect to the other inking devices 100. The movable frame 70 is again likewise movable by translation between an operating position (as illustrated in FIG. 5*a*) where the lowermost inking device 100* can cooperate, in the working position of the inking carriage 57, with the lowermost chablon cylinder 104*, and a pulled-back position (as illustrated in FIGS. 5*b* and 5*c*) where the lowermost inking device 100* is retracted away from the remaining inking devices 100. In FIGS. 5*b* and 5*c*, the movable frame 70 retracted to its pulled-back position is indicated by reference numeral 70', while the dashed-lines in FIGS. 5*b* and 5*c* indicate the operating position of the movable frame 70. FIG. 5*c* also shows that the frame 70 can be moved in the retracted position of the inking carriage.

As a further refinement of the above-described embodiments, a reflective panel can advantageously be provided at an upper location above an uppermost one of the plurality of inking devices, which reflective panel is disposed in such a way as to allow an operator to visually inspect the uppermost inking device by reflection onto the reflective panel. In the above-described embodiments, the reflective panel can be conveniently located at an upper portion of the inking carriage supporting the inking devices as schematically designated by reference numeral 110 in the Figures. This allows the operator to visually inspect the uppermost inking device from a normal operator position, without this necessitating the operator to climb to a higher position.

Various modifications and/or improvements may be made to the above-described embodiments without departing from the scope of the invention as defined by the annexed claims. For instance, while the disclosed embodiments relate to intaglio printing presses, the invention could be applicable to other types of printing presses, such as so-called Simultan-offset printing presses as used for the production of banknotes and like security documents (see e.g. European Patent Publication EP 0 949 069 A1 or International Publications Nos. WO 2007/042919 A2, WO 2007/105059 A1, and WO 2007/105061 A1).

In addition, the invention could be applied to move more than one selected inking device with respect to remaining inking devices, whether by way of individual movable frames or by way of one movable frame supporting more than one inking device. A movable frame could for instance be provided to support the uppermost inking device onto the inking carriage. Within the scope of the present invention, it should be appreciated that at least one selected inking device amongst the plurality of inking devices of the inking system is supported onto the inking carriage via a movable frame, which movable frame is supported by the inking carriage to allow movement of the selected inking device with respect to the inking carriage and with respect to a remaining part of the plurality of inking devices. In other words, and in contrast to the known solution disclosed in European Patent Publication No. EP 1 088 657 A1, the selected inking device can be moved together with the inking carriage supporting the other inking devices, while also allowing for an independent movement of the selected inking device with respect to the inking carriage and the other inking devices, irrespective of the position of the inking carriage.

Furthermore, while the above-described embodiments show that the movable frame can be translated along a horizontal plane between the operating position and the pulled-back position, displacement of the movable frame could be performed along any suitable trajectory, such as along a non-horizontal (i.e. inclined) plane or along a curved trajectory. This may in particular be contemplated in case the selected inking device must be moved so as to avoid interferences with nearby parts or components of the printing press.

LIST OF REFERENCE NUMERALS USED THEREIN

1 (sheet-fed) intaglio printing press (first embodiment)
1* (sheet-fed) intaglio printing press (second embodiment)
1** (sheet-fed) intaglio printing press (third embodiment)
2 sheet feeder
3 intaglio printing unit (first embodiment)
3* intaglio printing unit (second embodiment)
3** intaglio printing unit (third embodiment)
4 sheet delivery (with three delivery pile units)
5 optical inspection system (e.g. NotaSave®)
6 drying or curing unit
7 impression cylinder (three-segment cylinder)
8 intaglio cylinder (three-segment plate cylinder carrying three intaglio printing plates)
9 ink collecting cylinder/Orlof cylinder (three-segment blanket cylinder—first and second embodiments)
9* ink collecting cylinder/Orlof cylinder (two-segment blanket cylinder—third embodiment)
10 ink wiping system
11 sheet transporting system (sheet conveyor system with a pair of endless chains driving a plurality of spaced-apart gripper bars for holding a leading edge of the sheets)
50 stationary machine frame supporting impression cylinder 7 and intaglio cylinder 8 (first embodiment)
51 intermediate carriage supporting ink-collecting cylinder 9 and chablon cylinders 93, 93* (first embodiment)
52 inking carriage supporting inking devices 90 and movable frame 60 supporting lowermost inking device 90* (first embodiment)

52' inking carriage 52 in the retracted position (first embodiment)
54 stationary machine frame supporting impression cylinder 7, intaglio cylinder 8 and chablon cylinders 99, 99* (second embodiment)
55 inking carriage supporting inking devices 95 and movable frame 65 supporting lowermost inking device 95* (second embodiment)
55' inking carriage 55 in the retracted position (second embodiment)
56 stationary machine frame supporting impression cylinder 7, intaglio cylinder 8 and chablon cylinders 104, 104* (third embodiment)
57 inking carriage supporting inking devices 100 and movable frame 70 supporting lowermost inking device 100* (third embodiment)
57' inking carriage 57' in the retracted position (third embodiment)
60 movable frame (in operating position) supporting lowermost inking device 90* (first embodiment)
60' movable frame 60 in pulled-back position (first embodiment)
65 movable frame (in operating position) supporting lowermost inking device 95* (second embodiment)
65' movable frame 65 in pulled-back position (second embodiment)
70 movable frame (in operating position) supporting lowermost inking device 100* (third embodiment)
70' movable frame 70 in pulled-back position (third embodiment)
90 (upper four) inking devices (first embodiment)
90* lowermost inking device (first embodiment)
91 ink duct (first embodiment)
92 ink-application rollers (first embodiment)
93 (upper four) chablon cylinders/selective inking cylinders (first embodiment)
93* lowermost chablon cylinder/selective inking cylinder (first embodiment)
95 (upper four) inking devices (second embodiment)
95* lowermost inking device (second embodiment)
96 ink duct (second embodiment)
97 ink-transfer roller (second embodiment)
98 ink-application rollers (second embodiment)
99 (upper four) chablon cylinders/selective inking cylinders (second embodiment)
99* lowermost chablon cylinder/selective inking cylinder (second embodiment)
100 (upper three) inking devices (third embodiment)
100* lowermost inking device (third embodiment)
101 ink duct (third embodiment)
102 ink-transfer roller (lowermost position only—third embodiment)
103 ink-application rollers (third embodiment)
104 (upper three) chablon cylinders/selective inking cylinders (third embodiment)
104* lowermost chablon cylinder/selective inking cylinder (third embodiment)
110 reflective panel

The invention claimed is:

1. A printing press comprising an ink-receiving cylinder receiving ink from an inking system having a plurality of ink-applying cylinders or rollers arranged one above the other around part of a circumference of the ink-receiving cylinder, the ink-applying cylinders or rollers being inked by a corresponding plurality of inking devices, the printing press further comprising an inking carriage supporting the plurality of inking devices, which inking carriage can be moved with respect to the ink-receiving cylinder between a working position and a retracted position, wherein at least one selected inking device amongst the plurality of inking devices of the inking system is supported onto the inking carriage via a movable frame, which movable frame is supported by the inking carriage to allow movement of the selected inking device with respect to the inking carriage and with respect to a remaining part of the plurality of inking devices.

2. The printing press as defined in claim 1, wherein the movable frame is movable between an operating position where the selected inking device can cooperate, in the working position of the inking carriage, with a corresponding one of the ink-applying cylinders or rollers and a pulled-back position where the selected inking device is retracted away from the remaining part of the plurality of inking devices.

3. The printing press as defined in claim 2, wherein displacement of the movable frame between the operating position and the pulled-back position occurs by translation.

4. The printing press as defined in claim 3, wherein displacement of the movable frame between the operating position and the pulled-back position occurs along a horizontal plane.

5. The printing press as defined in claim 1, wherein the selected inking device is an inking device amongst the plurality of inking devices that is located at a lowermost position.

6. The printing press as defined in claim 1, wherein the ink-applying cylinders or rollers are located together with the ink-receiving cylinder in a supporting frame of the printing press, the inking carriage being moved away from the ink-applying cylinders or rollers and the ink-receiving cylinder in the retracted position.

7. The printing press as defined in claim 6, wherein the supporting frame is a stationary frame of the printing press.

8. The printing press as defined in claim 6, wherein the supporting frame is an intermediate carriage located between the inking carriage and a stationary frame of the printing press.

9. The printing press as defined in claim 1, wherein the inking carriage is suspended under supporting rails.

10. The printing press as defined in claim 1, wherein the printing press is an intaglio printing press.

11. The printing press as defined in claim 10, wherein the ink-applying cylinders or rollers are chablon cylinders applying ink directly onto a circumference of an ink-collecting cylinder of the intaglio printing press.

12. The printing press as defined in claim 10, wherein the ink-applying cylinders or rollers are chablon cylinders applying ink directly onto a circumference of an intaglio cylinder of the intaglio printing press.

13. The printing press as defined in claim 10, wherein the ink-applying cylinders or rollers are chablon cylinders, the selected inking device inking a selected one of the chablon cylinders which applies ink directly onto a circumference of a plate-cylinder of the intaglio printing press, while a remaining part of the chablon cylinders apply ink directly onto a circumference of an ink-collecting cylinder of the intaglio printing press.

14. The printing press as defined in claim 1, wherein the movable frame is allowed to move in both the working position and the retracted position of the inking carriage.

15. The printing press as defined in claim 1, wherein a reflective panel is provided at an upper location above an uppermost one of the plurality of inking devices, which reflective panel is disposed in such a way as to allow an operator to visually inspect the uppermost inking device by reflection onto the reflective panel.

* * * * *